US009919852B2

(12) United States Patent
Kaeser

(10) Patent No.: US 9,919,852 B2
(45) Date of Patent: Mar. 20, 2018

(54) COVER FOR A WASTE CONTAINER

(71) Applicant: Ludwig Kaeser, Sindelsdorf (DE)

(72) Inventor: Ludwig Kaeser, Sindelsdorf (DE)

( * ) Notice: Subject to any disclaimer, the term of this patent is extended or adjusted under 35 U.S.C. 154(b) by 227 days.

(21) Appl. No.: 13/917,397

(22) Filed: Jun. 13, 2013

(65) Prior Publication Data

US 2013/0277283 A1 Oct. 24, 2013

Related U.S. Application Data

(63) Continuation of application No. PCT/EP2011/071577, filed on Dec. 1, 2011.

(30) Foreign Application Priority Data

Dec. 14, 2010 (DE) ..... 10 2010 061 213

(51) Int. Cl.

| | |
|---|---|
| ***B07C 5/00*** | (2006.01) |
| ***B65D 55/00*** | (2006.01) |
| ***B65F 1/16*** | (2006.01) |
| ***B03C 1/30*** | (2006.01) |
| ***B07C 5/34*** | (2006.01) |

(52) U.S. Cl.

CPC ..... *B65D 55/00* (2013.01); *B03C 1/30* (2013.01); *B07C 5/34* (2013.01); *B65F 1/1607* (2013.01); *B65F 2210/124* (2013.01); *B65F 2210/1525* (2013.01)

(58) Field of Classification Search

CPC ... B03C 1/14; B07B 13/00; B07C 3/02; B65F 1/16; B65F 1/1607; B65D 5/6602; B65D 5/667; B65D 5/646; B65D 5/6626; B65D 5/723

USPC ..... 209/223.1, 254, 636, 698, 911, 926

See application file for complete search history.

(56) References Cited

U.S. PATENT DOCUMENTS

| | | | | |
|---|---|---|---|---|
| 4,632,253 | A | 12/1986 | Stroemgren et al. | |
| 4,782,970 | A | 11/1988 | Edwards | |
| 5,494,186 | A * | 2/1996 | Marsh | B65F 1/10 206/366 |
| 5,538,143 | A | 7/1996 | Pettersson | |
| 5,797,497 | A * | 8/1998 | Edwards | B07C 5/344 209/570 |
| 6,129,213 | A | 10/2000 | Edwards | |
| 6,724,305 | B2 * | 4/2004 | Edwards | B65F 1/1607 209/570 |
| 6,833,789 | B1 | 12/2004 | Carmen et al. | |

(Continued)

FOREIGN PATENT DOCUMENTS

| | | |
|---|---|---|
| DE | 19845541 | 8/1999 |
| WO | 2003/018441 | 3/2003 |
| WO | 2005/042382 | 5/2005 |

*Primary Examiner* — Joseph C Rodriguez
*Assistant Examiner* — Kalyanavenkateshware Kumar
(74) *Attorney, Agent, or Firm* — Simpson & Simpson, PLLC

(57) ABSTRACT

The invention relates to a cover (1) for a waste container (3), having an opening (5) that is formed in the cover (1). Waste (11) can be transferred into the waste container (3) via a sliding surface (9) of a slide (7), the surface being associated with the opening (5). At least one metal detector (13, 13*a*, 13*b*, 13*c*) is associated with the cover (1) such that metal components (15) of the waste (11) can be detected before transferring the waste (11) into the waste container (3).

11 Claims, 8 Drawing Sheets

(56) References Cited

U.S. PATENT DOCUMENTS

| | | | | |
|---|---|---|---|---|
| 7,683,779 | B1 * | 3/2010 | Pacheco | B65F 1/10 209/215 |
| 2008/0029415 | A1 * | 2/2008 | Wang | B65F 1/1607 206/361 |

* cited by examiner

COVER FOR A WASTE CONTAINER

CROSS REFERENCE TO RELATED APPLICATIONS

This application is filed under 35 U.S.C. § 120 and § 365(c) as a continuation of International Patent Application PCT/EP2011/071577, filed Dec. 1, 2011, which application claims priority from German Patent Application No. 10 2010 061 2118, filed Dec. 14, 2010, which applications are incorporated herein by reference in their entireties.

FIELD OF THE INVENTION

The present invention relates to a cover for a waste container.

BACKGROUND OF THE INVENTION

Usually, a plate with coarse food leftovers is pre-cleaned individually by hand or a rubber glove, sponge, napkins, hand scrapers or brushes in commercial kitchens, canteens and similar establishments in the catering or restaurant services. This pre-cleaning is unhygienic, time consuming and also ineffective.

Thus, the German patent application DE 198 45 541 A1 describes a preliminary plate cleaner that can be hygienic, effective and timesaving to remove food particles from dishes before entering into the dishwasher. This preliminary plate cleaner has different brush systems in order to provide an improved stripping of residues from plates. According to this design, an ambidextrous work is possible. A plate in each hand allows the staff to work faster, cleaner, more hygienic and in an effective way, so that the staff is not even in contact with the food particles. The preliminary plate cleaner itself has a dishwasher-safe stainless steel holder and the remover, which can be loosened quickly by a quick closure for cleaning. Even with a loosening of the quick closure a falling out of the detachable remover is prevented. The preliminary plate cleaner can be mounted in various positions on labor, irrigation and/or feeding tables or to/above waste containers.

In the kitchens of the restaurant or catering industry during intense activities at peak meal times often the required attention in the separation of food waste and reusable utensils is not present due to a lack the time. As it happens, for example, that on a plate with a napkin the cutlery is accidentally thrown into the waste container. For the owner or tenant of a catering industry, this is an enormous cost factor, as always new cutlery and food preparation utensils must be purchased.

Therefore covers or lids for waste containers are known which allow easy removal of food leftovers and also prevent accidental dumping of cutlery. An example of such a lid for a waste container shows the international patent application WO 03/018 441 A1. The body forming the lid defines a chute formation leading to an opening through which garbage can be fed via the body into a garbage container on which the body is located, in use. The walls of the chute formation are associated with a magnet that can trap metal objects. A flap, optionally also having a magnet associated herewith, is pivotally mounted on the body to provide for blocking of the opening while garbage is not being fed into an associated garbage container. The lid is intended to be used with garbage containers into which leftovers of eating establishments are discarded, in order to trap tableware that often are simultaneously discarded.

A similarly executed waste container lid is disclosed in the U.S. Pat. No. 6,129,213 A. A trash container lid facilitates easy disposal of food scraps while inhibiting inadvertent disposal of tableware. The trash container lid includes a cover configured to cover at least a portion of an opening in a trash container. A chute is formed in the cover and is configured to receive food scraps and to direct the food scraps into the trash container. At least one magnet is disposed proximate the chute to catch tableware inadvertently introduced thereinto. A scraper blade is formed to the cover proximate the chute such that food scraps scraped from plates and the like with the scraper fall through the chute and into the trash container.

The international patent application WO 2005/042382 A1 discloses an apparatus for removing cutlery from waste intended for a waste container. The apparatus is placeable above the waste container and defines a feed path. A closing device is provided for closing off the feed path that is adjustable between an open position and a closed position. A cutlery detector is provided to which the closing device is connected for adjusting the closing device from the open position to the closed position when the cutlery detector has detected the presence of cutlery.

U.S. Pat. No. 4,782,970 describes a lid that fits to the top of a garbage container to magnetically intercept tableware out of food trash being entered into the container. The lid presents a "U"-shaped channel or chute, extending toward an aperture sized to permit the food trash to enter into the trash container. While free-falling through the aperture, tableware is attracted and segregated out of food trash and held flat to one of the two opposed sidewalk mounting the magnets.

U.S. Pat. No. 4,632,253 describes an apparatus for separating cutlery from restaurant waste. A hopper forms a chute and is adapted to be placed above the opening of a waste container. A flap) arranged in the hopper is pivotable between two positions, namely a first position for closing off the opening and a second position for uncovering the opening. An electrical switching signal from an inductive type probe controls a drive member for pivoting the flap between the first and second positions.

U.S. Pat. No. 6,833,789 describes a trashcan mounted apparatus for scanning for metal objects. The apparatus includes a funnel shaped entryway. A detector coil surrounds the vertical walls for detecting metal passing through the opening. Control electronics coupled to the detector coil includes a speaker and a light indicator for warning that the detector coil has detected metal passing through the opening.

SUMMARY OF THE INVENTION

The invention has for its object to provide a cover for a waste container, with which the accidental dumping of all metallic components in the food waste is prevented. The object is achieved by a cover for a waste container, comprising:

- an opening formed in the cover;
- at least one sliding surface associated with the opening through which waste is transferred into the waste container;
- a slide is arranged such that an upper portion of the sliding surface projects above a surface of the cover; and
- at least one metal detector is assigned to the cover such that metal components of the waste are detectable and/or catchable prior to a transfer of the waste into the waste container.

The cover for a waste container according to the invention has a slide, which is arranged such that an upper portion of the sliding surface projects beyond a surface of the cover. At least one metal detector is associated with the cover such that metallic components of the waste prior to the transfer of the waste into the waste container can be detected and/or caught. At least one permanent magnet can associated with the cover such that metallic and magnetizable components of the waste are caught prior to the transfer of the waste into the waste container. The cover may be made of different materials, such as wood or plastic. Further, the cover itself may have different shapes. A shape may be round, but other embodiments of the cover can also be square. Ideally, if the shape of the cover is adapted to the cross-sectional shape of the waste container, so that full coverage of the opening of the waste is achieved. The cover should be sufficiently mechanically stable and easy to clean.

Also sliding surface of the slide can have different shapes and sizes. The sliding surface may be configured as a section of a funnel. It is also conceivable that the opening for the transfer of the waste has the form of a rectangle and to all four sides a sliding surface is assigned. Advantageously, at least one metal detector is associated with the cover such that metallic components of the waste are detected prior to the transfer of the waste into the waste container. The position of the least one metal detector at the cover has the advantage that both magnetizable metallic and metallic non-magnetizable components in the waste can be detected. It should be mentioned that the at least one metal detector can be supplied with the necessary energy in different manners. The power supply may be a battery or an accumulator or via a conventional power cord. The detailed operation of a metal detector is not discussed here, since this is well known to a skilled person.

Further may be associated with at least one metal detector, a counter, so that detected metallic components which are to be transferred via the cover to the waste container through carelessness, are counted. Thus, the metallic components are detected and the number of events detected (detection of a metallic component) can be read on the meter. Another possibility is that an electronic counter device via Wi-Fi using a computer logs the detected metallic components.

In a first embodiment at least one metal detector is arranged below the sliding surface. According to a second embodiment the metal detector is arranged close to the opening in the cover. The metal detector can surround the opening in the cover at least partially. In another embodiment, it is conceivable that the cover is provided with two metal detector assemblies. Here a metal detector is arranged below the sliding surface and a further metal detector is arranged at the opening in the cover.

According to a preferred embodiment, a single metal detector is mounted in the region of a front edge of the sliding surface and below the sliding surface. In addition to the metal detector a plurality of permanent magnets can be mounted beneath the sliding surface, so that metallic and magnetizable components are detected and caught on the sliding surface prior to the transfer of the waste into the waste container.

It is also advantageous if the cover is provided with at least one passive catch means and/or at least one active catch means. The active and/or passive catch means are positioned at the cover such that detected metallic components are collected prior to the transfer of waste to the waste container and therefore cannot be lost.

In a particular embodiment, the at least one passive catch means is a permanent magnet. A metallic and magnetizable element thus remains adhered to the permanent magnet of the cover of the waste container before it is transferred to the waste in the waste container.

But in order to catch metallic and non-magnetizable components prior to the transfer of the waste in the waste container, at least one active catch means is provided in another embodiment of the invention. The active catch means is brought into the fall area of the metallic components in case a signal of the at least one metal detector is generated. In this regard, an electronic controller is provided which controls the at least one active catch means so due to a signal of at least one metal detector so that the active catch means is in a catching position. After confirming the removal of the captured metallic component the catch means is brought back into a retracted position. This can be done automatically or manually.

In particular, the coverage is for a waste container for waste from food of restaurants, catering events and/or kitchens, so that metal cutlery and/or metallic food preparation utensils are detected before their transfer together with the waste into the waste container. Therefore, this invention is of interest for kitchens, catering events and restaurant services because it often happens that pieces of cutlery are unintentionally thrown into a waste container. By means of the cover according to the invention, the cutlery is detected by the at least one metal detector, and optionally trapped at least by one passive catch means at least by one active catch means, so that inadvertent discarding of metal cutlery and/or metallic food preparation utensils is prevented. Furthermore, the cover according to the invention is used for a waste container for medical waste so that metallic surgical instruments and needles for syringes are detected and optionally caught prior to their transfer into the waste container.

It is also advantageous if the inventive cover of the waste container has a slide with an upper portion that extends above a surface of the cover. Due to configuration, the upper portion of the slide provides a surface on which a plate having food waste thereon can be tapped. The food waste can be transferred from the sliding surface into the opening of the cover and the food particles like must not be removed by hand or from the plate. Moreover, the sliding surface provides an extended reaction zone for the metal detectors, so that the metallic parts are securely detected and caught by the passive and/or active catch means.

According to a particularly advantageous embodiment, an additional sliding surface is provided opposite to the first slide, which has a smaller inclination than the sliding surface of the first slide. A front edge of the slide surface is arranged such that the waste from the further sliding surface drops prior to its transfer into the waste container onto the sliding surface of the first slide. The sliding surface of the first slide has in the area of its the front edge a smaller gradient than the rest of the sliding surface of the first slide. Thus, the slip velocity of the waste slows down a little, and the detection of the metallic components of the waste through by the at least one metal detector is assured. The metal detector is positioned at the front edge of the sliding surface. For this purpose the cover has formed a seating in which the detector is located.

Below the surface of the cover a chamber is formed in which control electronics for the metal detector is located. Preferably, the cover is made in one piece by an injection molding of a polymer. The molded cover has a circumferential edge with which the cover rests on the waste container.

It is understood by those skilled in the art, that other arrangements of the components of the invention, like the at least one metal detector, the at least one active catch means and at least one passive catch means, with respect to the cover may be made without departing from the scope of the invention.

BRIEF DESCRIPTION OF THE DRAWINGS

In the following, embodiments of the invention and its advantages are further illustrated by the accompanying figures. The proportions of the individual elements do not always correspond to the real proportions, since some forms are simplified and other forms, for clarity reasons are shown enlarged.

DETAILED DESCRIPTION OF THE INVENTION

Figure 1:
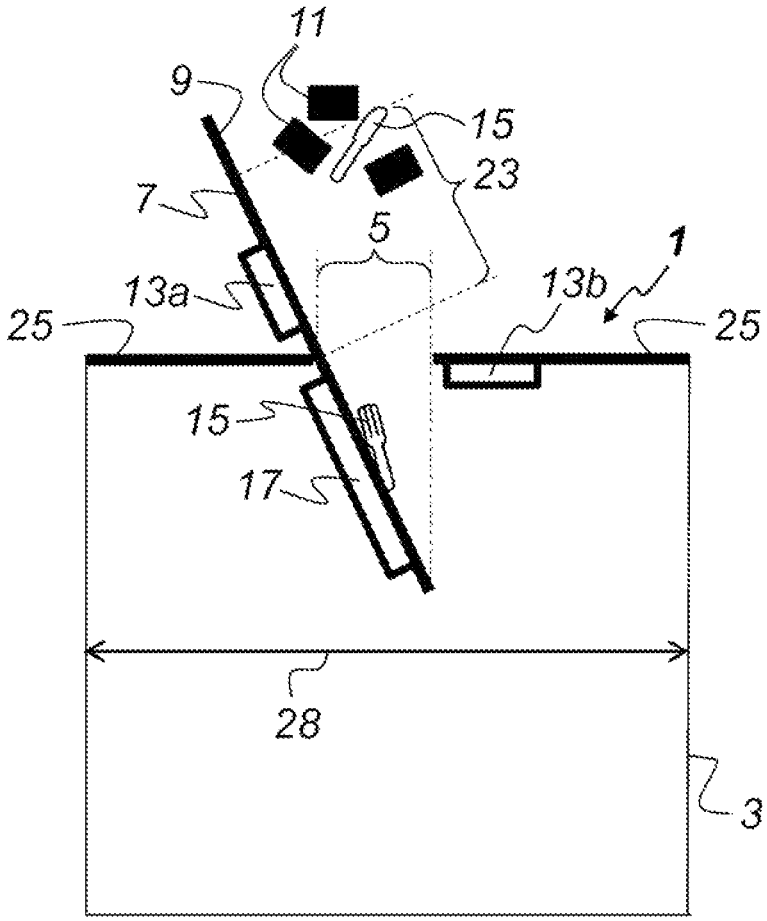
FIG. 1 shows a schematic view of a first embodiment of the inventive cover for a waste container.

For the same or equivalent elements of the invention, like reference numerals are used. Further, for the sake of clarity, only reference numerals in the various figures are illustrated which are necessary for the description of the respective figure. The illustrated embodiments are only examples of how the invention can be designed to cover a waste container and do therefore not constitute a limitation of the invention.

FIG. 1 shows a schematic view of a first embodiment of a cover 1 for a waste container 3 according to the invention. In the cover 1 an opening 5 is formed and a sliding surface 9 of a slide 7 is associated with the opening 5, so that the waste 11 can be transferred into the waste container 3. In the present embodiment, two metal detectors 13*a*, 13*b* are positioned at the cover 1 such that a metallic component 15 of the waste 11 can be detected prior to the transfer of the waste 11 into the waste container 3. The metal detectors 13*a*, 13*b*, allow the detection of both magnetizable metallic components 15 and non-magnetizable metallic components 15 in the waste 11.

In the embodiment according to FIG. 1, a metal detector 13*a* is arranged below the sliding surface 9. A further metal detector 13*b* is located at the opening 5 of the cover 1. The further metal detector 13*b* at least partially surrounds the opening 5.

As described above, it is advantageous when the cover 1 has at least one passive catch means which is at least one permanent magnet 17. The permanent magnets 17 are assigned to the cover 1 such that the metal components 15 are detected and caught prior the transfer of the waste 11 into the waste container 3. Thus the metal components 15 cannot be lost. Magnetizable and metallic components 15 remain attached to the slide 7 of the waste container 3 by the magnetic force of the permanent magnet 17 and are not transferred into the waste container 3. In order to enable a secure transfer of the waste 11 into the waste container 3, the slide 7 is arranged such that the sliding surface 9 of an upper portion 23 extends above a surface 25 of the cover 1. A lower portion 24 of the sliding surface 9 of the slide 7 extends into the waste container 3.

The cover 1 is mainly used for a waste container 3 for waste 11 from food leftovers, so that metal cutlery 15 and/or metallic food preparation utensils are detected and/or caught before the transfer of the waste 11 in the waste container 3. Thus, inadvertent discarding of magnetizable and/or non-magnetizable metallic pieces of cutlery 15, and/or food preparation utensils is prevented. In the embodiment shown here a first item of cutlery 15 is detected by a metal detector 13*a* or 13*b* and then is captured by permanent magnet 17. As described above, the cover 1 according to the invention can be used for a waste container 3 for medical waste 11, such that metallic surgical instruments and the like.

Figure 2:
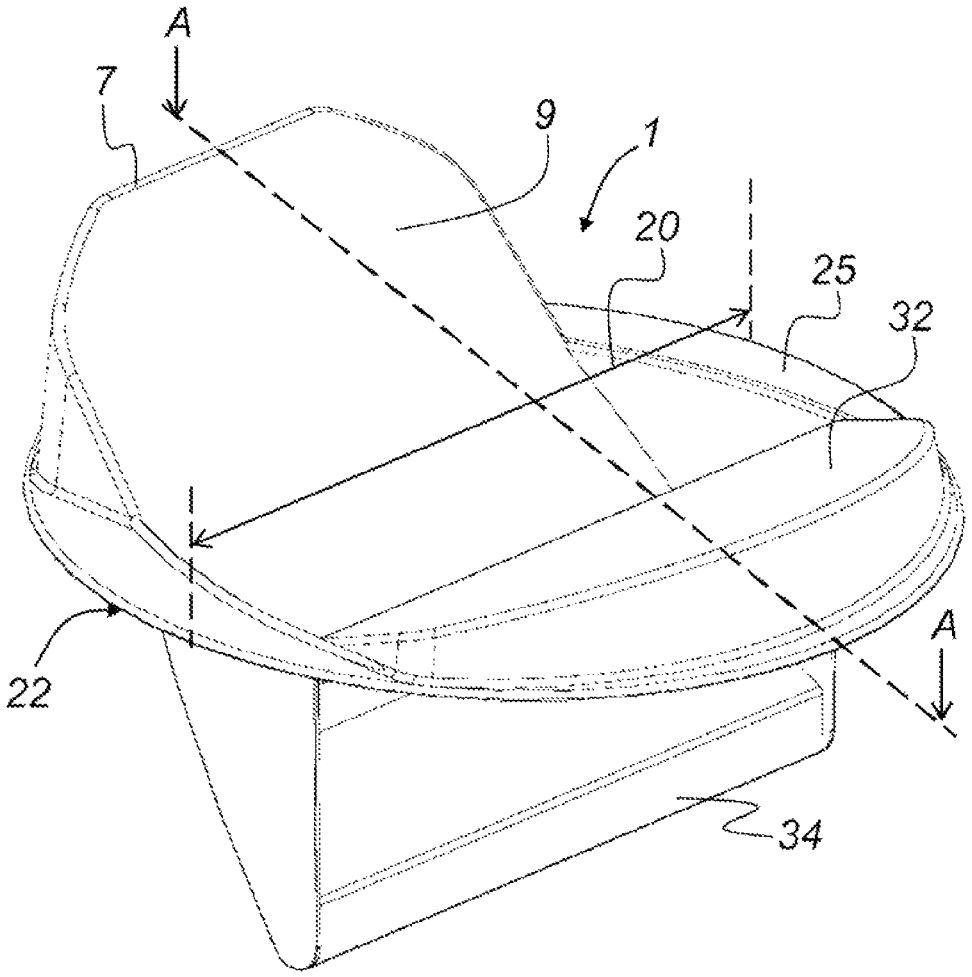
FIG. 2 shows a perspective view of a possible further embodiment of the inventive cover for a waste container.

FIG. 2 shows a perspective view of a further possible embodiment of the inventive cover 1 for a waste container 3 (not shown here). The waste container 3 has a substantially circular cross section and has a diameter 20. In the event that the waste container 3 has a larger diameter 28, as the cover 1, an adapter 30 is placed on the waste container 3 and the cover 1 is fixed on the corresponding adapter 30 (also see FIG. 10). In the embodiment shown in FIG. 2 a further sliding surface 32 is provided opposite to the sliding surface 9 of the slide 7. The further sliding surface 32 is arranged such that it inclined and directed towards the slide surface 9 of the slide 7. A front edge 34 of the slide 7 is provided substantially below the surface 25 of the cover 1. By the inventive arrangement of the sliding surface 9 of the slide 7, both above and below the surface 25 of the cover 1, it is ensured that the waste 11 will remain for a certain amount of time on the sliding surface 9 of the slide 7 so that the metallic components 15 of the waste 11 can be detected and removed. The cover 1 has a peripheral edge 22 with which the cover 1 is seated on the waste container 3 or on an adapter 30 for the cover 1. The cover 1 is integrally formed by an injection molding process from a polymer.

Figure 3:
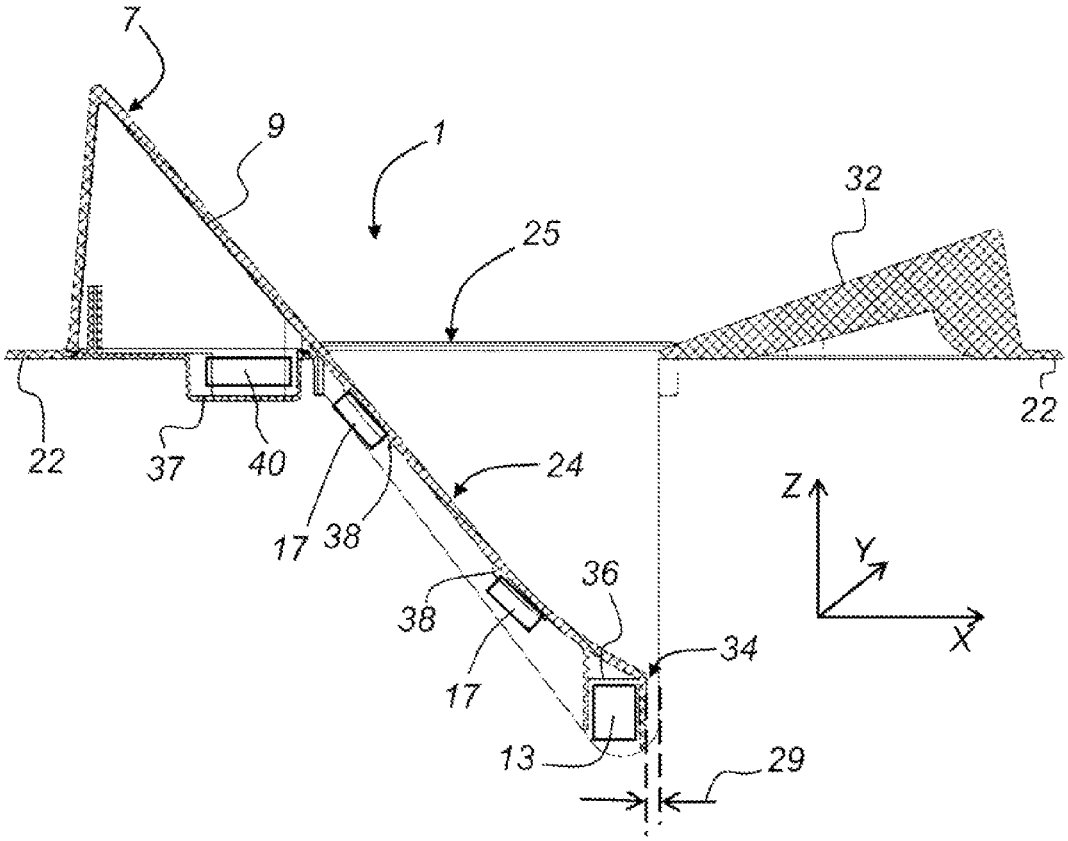
FIG. 3 shows a sectional view of the embodiment shown in FIG. 2, taken along line A-A in FIG. 2.

FIG. 3 shows a sectional view of the inventive cover 1. Across the sliding surface 9 of the slide 7 a further sliding surface 32 is provided which is inclined to and faces the sliding surface 9 of the slide 7. The further sliding surface 32 has a leading edge 35 which is formed slightly below the surface 25 of the cover 1. The further sliding surface 32 has a smaller inclination than the sliding surface 9 of the slide 7. The inclination of the further sliding surface 32 has an advantage, since the waste 11 can be safely transferred from further sliding surface 32 into the waste container 3. For this purpose, the front edge 35 of the further sliding surface 32 is arranged so that the waste 11 drops from the further sliding surface 32 onto the sliding surface 9 of the slide 7 before it is transferred into the waste container 3. When projected in the Z-direction, the front edge 35 of the further sliding surface 32 is spaced apart from the front edge 34 of the sliding surface 9 of the slide 7 by a distance 29, The distance 29 of the front edge 35 of the further sliding surface 32 is dimensioned such that the waste 11 cleared away from the further sliding surface 32 drops onto the sliding surface 7 of the slide 9 before it is falls into the waste container 3.

In the embodiment shown in FIG. 3 a seating 36 is formed in the region of the front edge 34 of the sliding surface 9 of the slide 7 in which the metal 13 detector is housed. Below the surface 25 of the cover 1 further a compartment 37 is formed in which the electronics and control 40 of the metal detector 13 is placed. Below the lower portion 24 of the sliding surface 9 of the slide 7 a plurality of seatings 38 are formed for the permanent magnets 17.

Figure 4:
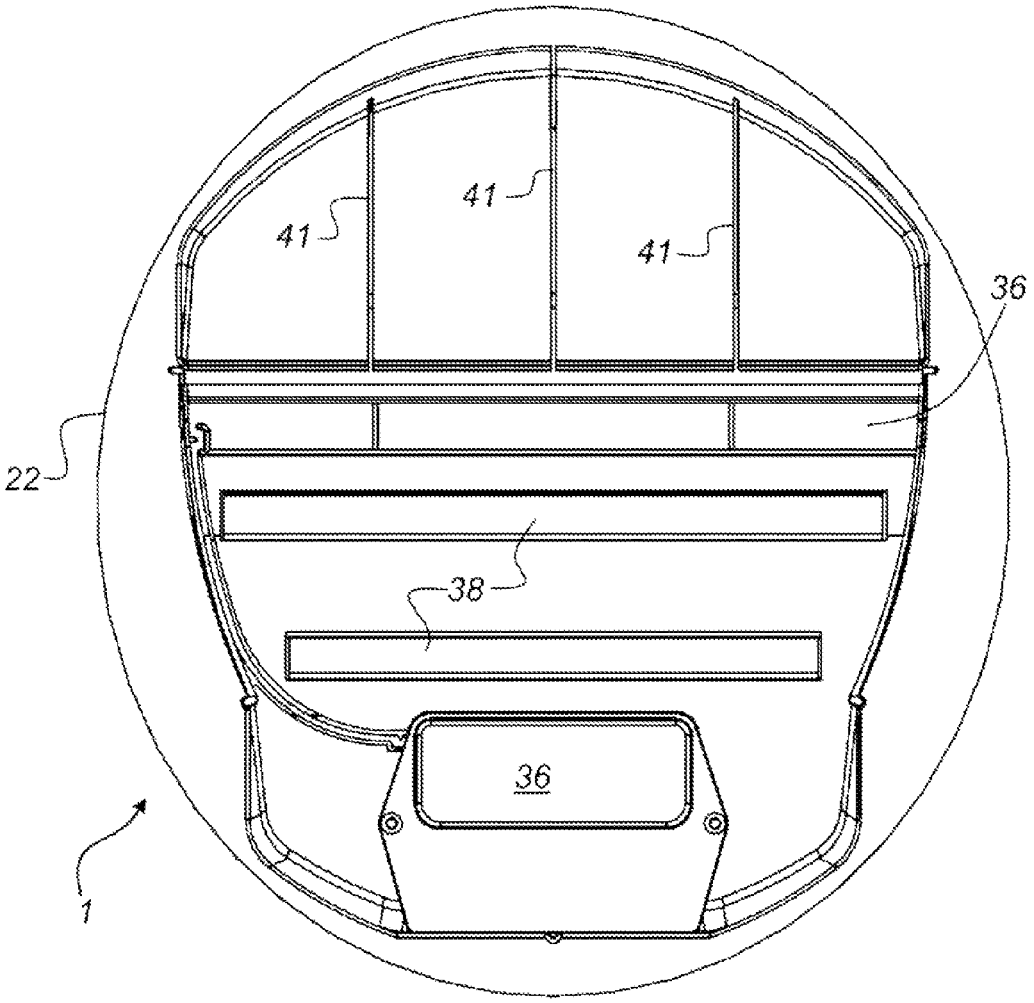
FIG. 4 shows a bottom view of the embodiment of the inventive cover for a waste container in FIG. 2.

FIG. 4 shows the bottom view of the embodiment of the inventive cover 1, shown in FIG. 2, for the waste container 3. Below the lower portion 24 of the sliding surface 9 of the slide 7, the seatings 38 are formed for the permanent magnets 19. Similarly, in the region of the front edge 35 of the sliding surface 9 of the slide 7 a seating 36 is formed for the metal detector 13. On the underside of the further sliding surface 32 a plurality of bars 41 are formed for a mechanical stabilization of the further sliding surface 32. Similarly, the compartment 37 is formed for the electronics and control 40 at the underside 26 of the cover 1. The compartment 37 can be closed with a cover not shown so as to provide protection against contamination and water spill. The seatings 38 for the permanent magnets 17, the seating 36 for the metal detector 13, the compartment 37 and the bars 41 are formed during the production of the one-piece cover 1 by an injection molding process.

Figure 5:
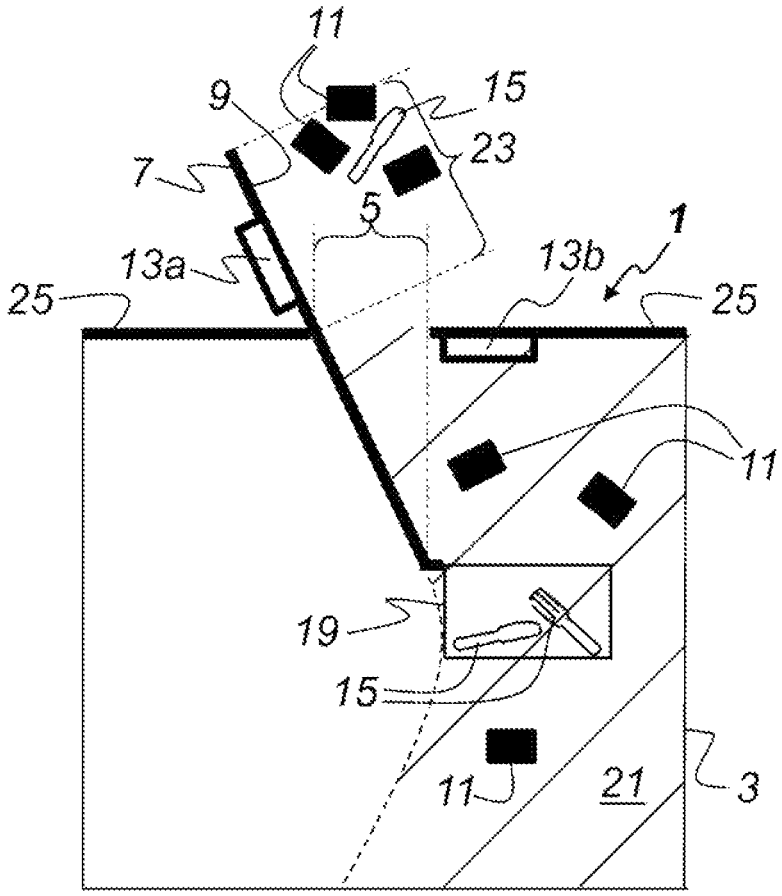
FIG. 5 shows a schematic view of a second embodiment of the inventive cover for a waste container.

As shown in the embodiment in FIG. 5, the non-magnetizable components 15 of the waste 11 are captured active catching means 19, which is coupled in a suitable electric manner to the metal detectors 13*a*, 13*b*.

The slide 7 has the upper portion 23, which projects above the surface 25 of the cover 1. Thus, the waste 11 (leftovers on the plate) can be tapped off from the plate at this upper portion 23 of the slide 7 and consequently the waste 11 is transferred from plate into the opening 5 of the cover 1. Therefore, the waste 11 (food particles) must not be pushed forcibly by hand or any other object from the plate.

With regard to the operation of the metal detectors 13*a*, 13*b*, for example with battery or accumulator, and/or a conventional power supply, reference is made to the above description. The signals from the metal detectors 13*a*, 13*b* are registered by a counter (not shown). The schematic view of present embodiment of the inventive cover 1 for the waste container 3 shows two metal detectors 13*a*, 13*b*. However, an active catching means 19 is provided instead of the at least one permanent magnet 17 (see FIG. 1).

The advantage of the active catching means 19 is that non-magnetizable metallic components 15 are catchable and are not lost. For example, the active catching means 19 is formed in the cover 1, such that the active catching means 19 can be brought into a falling area 21 (catching position) if there is a signal from the metal detector the 13*a* and/or 13*b*. The falling area 21 is shown hatched in FIG. 5. It is also conceivable to provide further active catching means 19 at or close to the cover 1, which are brought on demand into the falling area 21 of the waste 11 and the metallic components 15, respectively. According to this embodiment, the arrangement of the metal detectors shows only one possible configuration out of several possibilities. The arrangement shown herein is not to be construed as limiting the invention.

Figure 6:
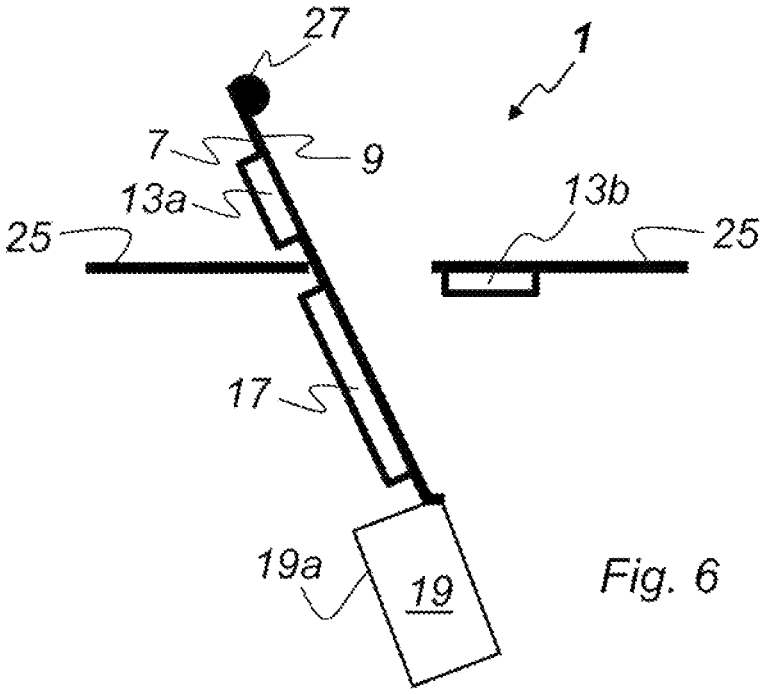
FIG. 6 shows a schematic view of the cover, wherein the waste container is not shown for clarity reasons, and the active catch means is in a retracted position and not in the catching position.

FIG. 6 shows a schematic view of the cover 1 and the waste container 3 is not shown for clarity reasons. As described in the two previous figures, the cover, shown here, also includes two metal detectors 13*a*, 13*b*. The cover 1 is provided with at least one permanent magnet 17 and at least one active catching means 19 so that metallic and magnetizable components 15 (not shown here) and metallic and non-magnetizable components 15 can be trapped prior to their transfer into the waste container 3.

As already mentioned, the active catching means 19 in the cover 1 is formed such that, due to a signal from the metal detector 13*a* or 13*b* (also see FIG. 5) of the metal components 15 the active catching means 19 can be brought into a falling area 21. In the embodiment shown in FIG. 6 the active catching means 19 is in a retracted position 19*a* if no metallic components 15 are detected by the metal detectors 13.

Further, the cover 1 of the embodiment shown in FIG. 6 has a scraper 27 which is attached to an upper portion 23 of the slide 7 which in turn makes the tapping of the waste 11 (food waste) from the plate easier.

Figure 7:
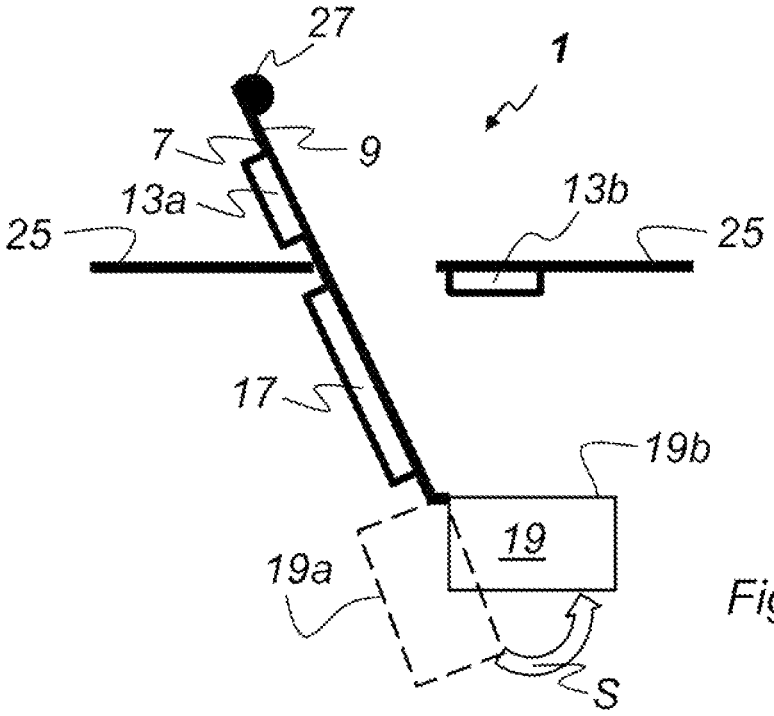
FIG. 7 shows the representation of FIG. 6, wherein the active catch s is brought into the catch position.

FIG. 7 schematically shows the transition of the active catching means 19 from the retracted position 19*a* into a catching position 19*b*. By means of an electronic controller (not shown) the active catching means 19 is controlled. The signals from the metal detectors 13*a* and/or 13*b* are used that the active catching means 19 is brought into a catching position 19*b*, that is, in the falling area 21 of the metallic components 15, or is brought back into its retracted position 19*a*. In the embodiment shown, the active catching means 19 is brought by a pivoting motion into the catching position 19*b*.

Figure 8:
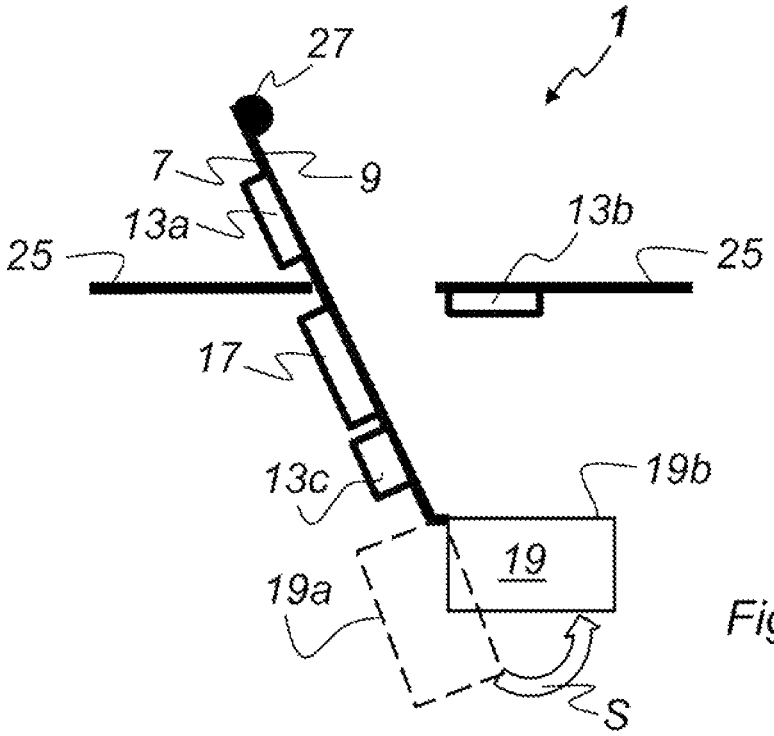
FIG. 8 shows a schematic view of another embodiment of the invention, wherein the waste container is not shown for clarity reasons.

FIG. 8 shows a schematic view of another embodiment of the invention. The cover 1 has three metal detectors 13*a*, 13*b*, 13*c*, The two metal detectors 13*a*, 13*b* are arranged as in the previous FIGS. 1 to 4, that is, below the sliding surface 9 of the slide 7, and in the region of the opening 5 of the cover 1. The third metal detector 13*c* is disposed below the slide 7 and after a permanent magnet 17, so that a triple detection of metal components 15 is given. Furthermore, an active catching means 19 is provided in the cover 1 such that the active catching means 19 can be brought into the falling region 21 of the metallic components 15 due to a signal from all three of metal detectors 13*a*, 13*b*, 13*c*. The magnetizable and metallic components 15 are already captured by the passive catching means 17 (permanent magnet), so that metal components 15 do not cause the third detector 13*c* to deliver a signal. Therefore, the active catching means 19 need not be brought into the catching position 19*b*.

Figure 9:
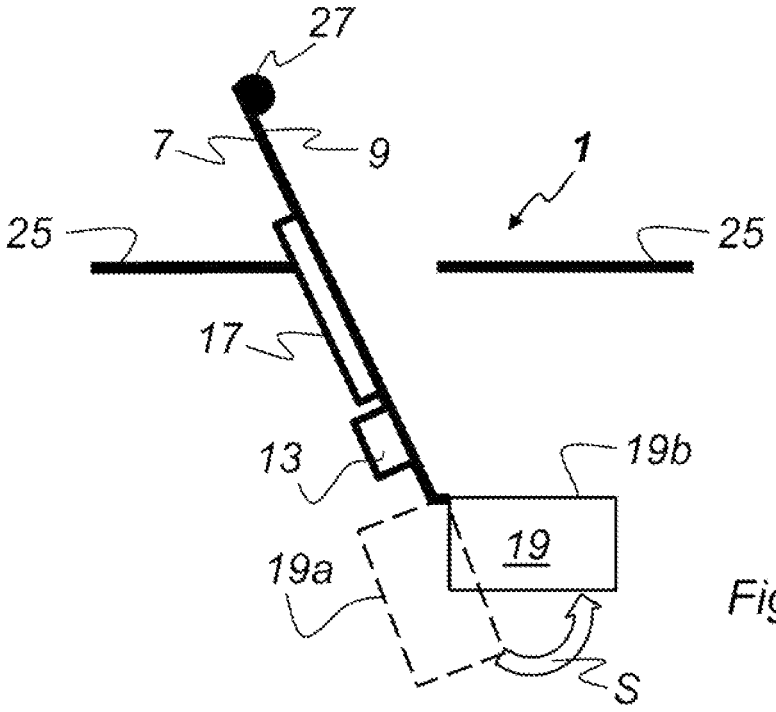
FIG. 9 shows a schematic view of an additional embodiment of the invention.

FIG. 9 shows a schematic view of an additional embodiment of the invention, but also without a waste container 3. The cover 1 has only one metal detector 13, which is arranged after the one permanent magnet 17 and below the sliding surface 9 of the slide 7. Metallic and magnetizable components 15 are captured by the permanent magnet 17. Other metallic and non-magnetizable components 15 are detected by the metal detector 13 downstream of the permanent magnet 17 and due to a signal from the metal detector 13 the passive catching means 19 captures the metallic and non-magnetizable components 15 prior to the transfer of the waste 11 into the waste container 3.

Figure 10:
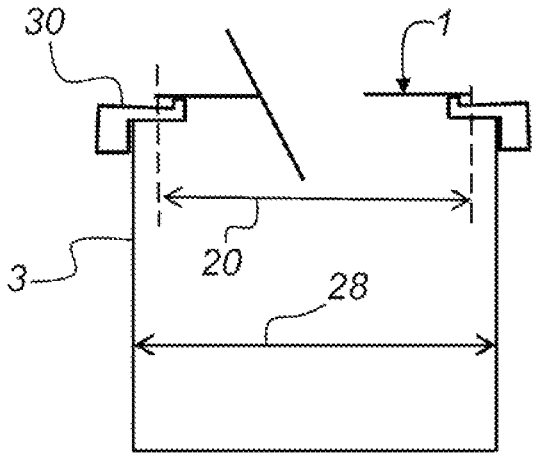
FIG. 10 shows a waste container, which is provided with an adapter for attaching or mounting the cover.

FIG. 10 shows a schematic view of an inventive cover 1 placed on a waste container 3. The diameter 28 of the waste container 3 is greater than the diameter 20 of the cover 1. In order to attach or mount the cover 1 onto the waste container 3, an adapter 30 is provided. The adapter 30 according to the invention, the cover 1 is placed.

The invention has been described with reference to preferred embodiments. However, it is conceivable to one skilled in the art that modifications or changes may be made to the invention without departing from the scope of the claims.

What is claimed is:

1. A one piece cover for a waste container, comprising:

an opening formed in the cover;

at least one sliding surface provided with the opening through which waste is transferred into the waste container;

a slide, including the at least one sliding surface, is rigidly arranged on the cover such that an upper portion of the sliding surface projects above a surface of the cover and a lower portion of the sliding surface of the slide extends into the waste container, wherein the lower portion includes a front edge;

a reduced slope, which is formed in a region of the front edge of the sliding surface of the slide, wherein the slope is smaller than the rest of the sliding surface of the slide; and, a first metal detector arranged below the sliding surface in a seating in the region of the front edge of the sliding surface and the first metal detector is arranged such that metal components of the waste are detectable prior to a transfer of the waste into the waste container.

2. The one piece cover according to claim 1, wherein the first metal detector is mounted below the sliding surface and in the region of the front edge.

3. The one piece cover according to claim 1, wherein a plurality of permanent magnets are attached to the cover underneath the sliding surface so that metallic and magnetizable components of the waste are catchable on the sliding surface before the transfer of the waste into the waste container.

4. The one piece cover according to claim 1, wherein at least one active catching means is designed such that, due to a signal of the first metal detector, the active catching means is transferable into a falling area of said metallic components.

5. The one piece cover according to claim 1, wherein across the opening from the slide a further sliding surface is formed which has a smaller inclination than the sliding surface of the slide.

6. The one piece cover according to claim 5, wherein a leading edge of the further sliding surface is arranged such that waste to be removed from the further sliding surface falls prior to its transfer into the waste container onto the sliding surface of the slide.

7. The one piece cover according to claim 1, wherein a chamber is formed below the surface of the cover, in which electronics and a controller for the first metal detector are placed.

8. The one piece cover according to claim 1, wherein the one piece cover is formed by a polymer injection molding process.

9. The one piece cover according to claim 1, wherein the cover has a circumferential edge with which the cover rests on the waste container.

10. The one piece cover according to claim 9, wherein the cover rests with the circumferential edge on an adapter, if a diameter of the waste container is greater than a diameter of the cover.

11. A one piece cover for a waste container, comprising:

an opening formed in the cover;

at least one sliding surface provided with the opening through which waste is transferred into the waste container;

a slide, including the at least one sliding surface, is rigidly arranged on the cover such that an upper portion of the sliding surface projects above a surface of the cover and a lower portion of the sliding surface of the slide extends into the waste container;

a first metal detector arranged below the sliding surface; and, a further sliding surface arranged across the opening from the at least one sliding surface and above the surface of the cover, the further sliding surface having a smaller inclination than the sliding surface of the slide;

wherein:

the sliding surface of the slide includes a reduced slope formed in the region of a front edge of the sliding surface which is smaller than the rest of the sliding surface of the slide; and, the first metal detector is arranged such that metal components of the waste are detectable prior to a transfer of the waste into the waste container.

* * * * *